US009538279B2

(12) United States Patent
Lu

(10) Patent No.: US 9,538,279 B2
(45) Date of Patent: Jan. 3, 2017

(54) HEADPHONE CONTROLLING SYSTEM AND PORTABLE ELECTRONIC DEVICE EMPLOYING SAME

(71) Applicant: FIH (HONG KONG) LIMITED, Kowloon (HK)

(72) Inventor: Sheng-Yi Lu, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 62 days.

(21) Appl. No.: 14/567,899

(22) Filed: Dec. 11, 2014

(65) Prior Publication Data

US 2015/0208157 A1 Jul. 23, 2015

(30) Foreign Application Priority Data

Jan. 21, 2014 (TW) ..... 103102040 A

(51) Int. Cl.
*H04R 1/00* (2006.01)
*H04R 1/10* (2006.01)

(52) U.S. Cl.
CPC ..... *H04R 1/1041* (2013.01); *H04R 2499/11* (2013.01)

(58) Field of Classification Search
USPC ..... 381/74
See application file for complete search history.

(56) References Cited

U.S. PATENT DOCUMENTS 9,173,021 B2 * 10/2015 Zurek ..... H04R 3/00
2014/0355778 A1 * 12/2014 Cheng ..... H04R 1/1041 381/74

* cited by examiner

*Primary Examiner* — Quynh Nguyen
(74) *Attorney, Agent, or Firm* — Zhigang Ma

(57) ABSTRACT

A headphone controlling system is used in a portable electronic device to control a playing mode of a headphone connected to the portable electronic device. The headphone controlling system includes a processor, a storage module, a manual controlling module, a positioning module, and a switching module. The storage module stores map data, street traffic data, and automatic control information. The manual controlling module manually switches the playing mode; when it is determined that the portable electronic device is on a heavy traffic street, the positioning module transmits the automatic control information in the storage module to the processor to generate and transmit a control signal according to the automatic control information to the switching module, thereby automatically switching the playing mode. A portable electronic device employing the headphone controlling system is also provided.

20 Claims, 4 Drawing Sheets

HEADPHONE CONTROLLING SYSTEM AND PORTABLE ELECTRONIC DEVICE EMPLOYING SAME

FIELD

The present disclosure relates to a headphone controlling system, and particularly relates to a headphone controlling system automatically switching sound channels and a portable electronic device employing the headphone controlling system.

BACKGROUND

Some people like to use headphones to listen to audio or make a call on portable electronic devices, such as smart phones. If outside, the volume needs to be increased due to environmental noise.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
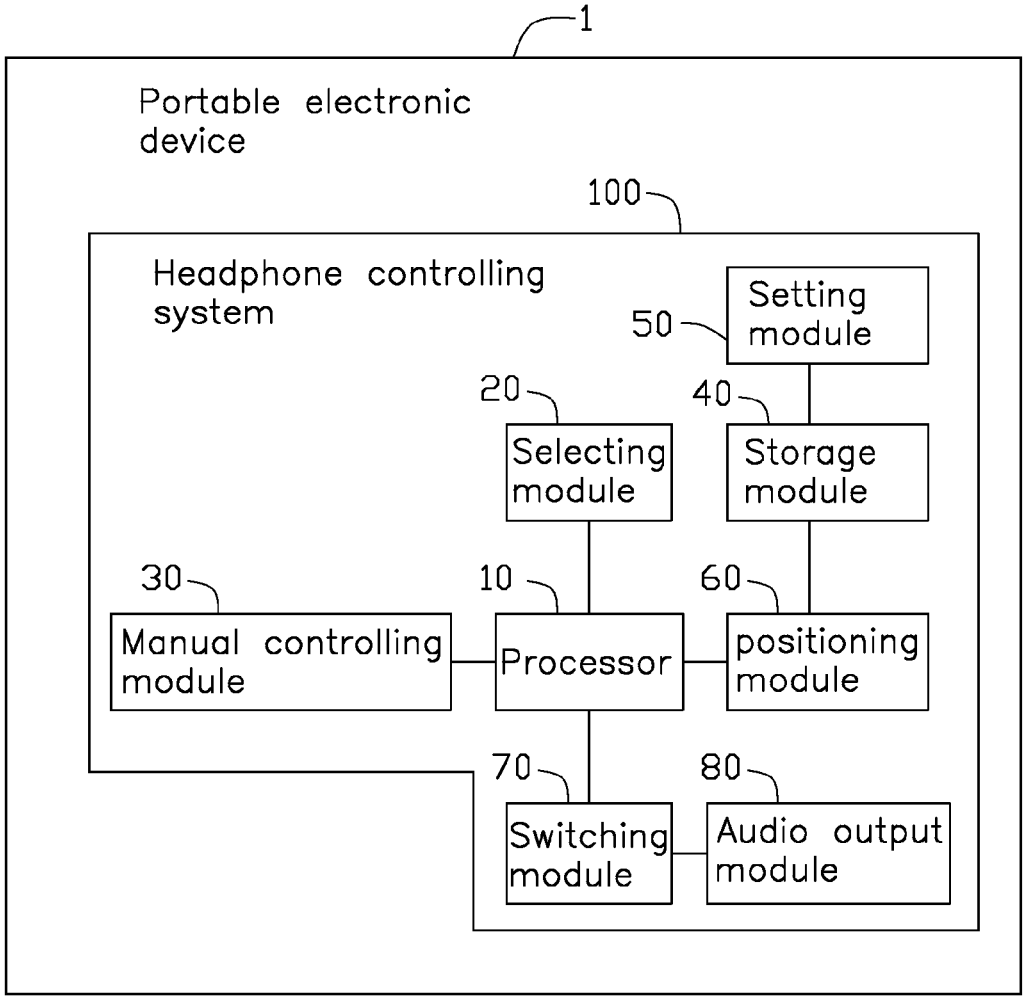
FIG. 1 is a block diagram of a first embodiment of a portable electronic device employing a headphone controlling system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates at least one embodiment of a headphone controlling system 100 applied to a portable electronic device 1. The portable electronic device 1 can be a smart phone or a tablet computer having audio playing function and a user interface. The portable electronic device 1 can connect to an external headphone for playing audio. The headphone controlling system 100 is used for controlling and switching playing modes of the headphone. The headphone is originally in a two channel playing mode, that is, the headphone plays on both left and right channels. In addition, the headphone can be in a single channel playing mode, that is, the headphone plays on only one channel. The single channel playing mode includes a right channel playing mode and a left channel playing mode. When the headphone is in the right channel playing mode, the headphone only plays on the right channel and stops playing on the left channel; when the headphone is in the left channel playing mode, the headphone only plays on the left channel and stops playing on the right channel.

The headphone controlling system 100 includes a processor 10, a selecting module 20, a manual controlling module 30, a storage module 40, a setting module 50, a positioning module 60, a switching module 70, and an audio output module 80.

The processor 10 is electrically connected to the selecting module 20, the manual controlling module 30, the positioning module 60, and the switching module 70. The processor 10 is used to receive and process data and information from other components, and further generates and outputs control signals. In one embodiment, the processor 10 receives data and information from the selecting module 20, the manual controlling module 30, and the positioning module 60, and further transmits control signals to the switching module 70.

The selecting module 20 is used to select controlling modes of the headphone controlling system 100. The selecting module 20 can select an automatic controlling mode and a manual controlling mode for the headphone. When in the automatic controlling mode, the processor 10 receives data and information from the positioning module 60 and transmits control signals to the switching module 70. When in the manual controlling mode, the processor 10 receives data and information from the manual controlling module 30 and transmits control signals to the switching module 70.

The manual controlling module 30 can be used for manual operation by the user to control the headphone. In the manual controlling mode, a user can input manual control information via the manual controlling module 30, and the manual controlling module 30 transmits the manual control information to the processor 10. For instance, the user can input single channel control information to control the headphone to play sound on a single channel. In the first embodiment, the manual controlling module 30 can be a user interface of the portable electronic device 1; a user can input the manual control information via the user interface.

The storage module 40 is used to store predetermined data. In one embodiment, the storage module 40 stores map data and street traffic data. The street traffic data can designate that there is heavy traffic on these streets on the map, which warns the user to pay more attention to the surrounding environment.

The setting module 50 is used to preset the predetermined data of the storage module 40. The setting module 50 presets the street traffic data, by marking heavy traffic on the map, in order to attract the attention of the user. When in the automatic mode, the setting module 50 can preset the playing mode of the headphone when the portable electronic device 1 is positioned in the marked heavy traffic; that is the single channel playing mode is preset in the automatic mode. The setting module 50 can preset automatic control information including single channel control information for controlling the headphone playing with single channel. The automatic control information can be stored in the storage module 40.

The positioning module 60 is used to position the portable electronic device 1. The positioning module 60 has a Global Positioning System (GPS) function, and can operate cooperatively with the map data and the street traffic data in the storage module 40. When the positioning module 60 is located in the area of marked heavy traffic on the map, then the presetting automatic control information stored in the storage module 40 is transmitted to the processor 10.

The switching module 70 switches the playing mode of the headphone according to the control signals received from the processor 10. For instance, when the control signal is to play sound on the right channel, the switching module 70 switches the headphone to play on right channel only.

The audio output module 80 outputs the audio processed by the switching module 70 to the headphone. When a playing mode of a headphone processed is a two channel playing mode, the audio output module 80 outputs the audio on both two channels. When a playing mode of a headphone processed is a single channel playing mode, the audio output module 80 outputs the audio on only one channel and stops outputting to the other channel.

When user selects the manual controlling mode via the selecting module 20 to control the headphone, the user inputs manual control information via the manual controlling module 30 to control the playing mode, such as a right channel playing mode. The manual controlling module 30 transmits the manual control information to the processor 10, thereby the processor 10 accordingly generates and transmits a control signal to the switching module 70. The switching module 70 switches to the right channel playing mode according to the control signal. The audio output module 80 outputs audio to the right channel and stops outputting audio on the left channel. In this way, user can manually switch the playing mode of the headphone.

When user selects the automatic controlling mode via the selecting module 20 to control the headphone, the positioning module 60 positions a location of the portable electronic device 1. When the location moves from ordinary unmarked street on the map to the marked heavy traffic of the map, the positioning module 60 transmits the presetting automatic control information in the storage module 40 to the processor 10, for instance, the automatic control information is a left channel playing mode. The processor 10 generates and transmits a control signal according to the automatic control information to the switching module 70. The switching module 70 switches to the left channel playing mode according to the control signal. The audio output module 80 outputs audio to the left channel and stops outputting audio to the right channel. In this way, the headphone controlling system 100 can automatically switch the sound playing mode of the headphone.

In one embodiment, the storage module 60 further stores automatic restoring control information for the headphone, that is restoring a single channel playing mode to two channel playing mode. When the location of the portable electronic device 1 positioned by the positioning module 60 is out of the marked heavy traffic of the map, the positioning module 60 transmits the automatic restoring control information in the storage module 40 to the processor 10 to restore the headphone to be in two channel playing mode from the single channel playing mode. The audio outputting module 80 restores to output audio on both channels. In this way, the portable electronic device 1 can switch different playing modes according to different locations.

Figure 2:
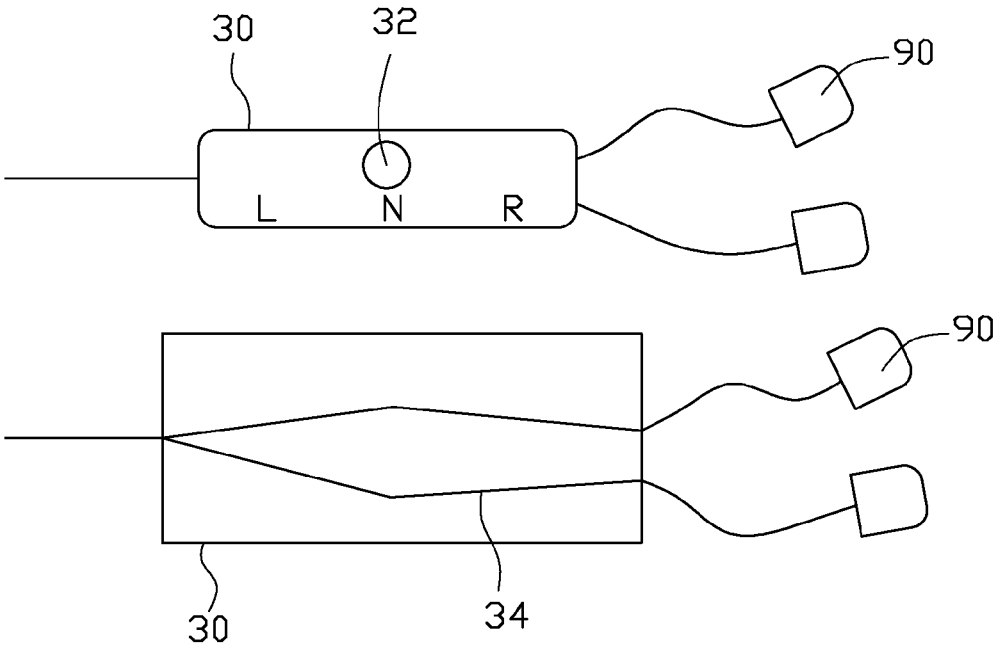
FIG. 2 is an isometric view of a second embodiment of a manual controlling mode of the headphone controlling system in a first state.
Figure 3:
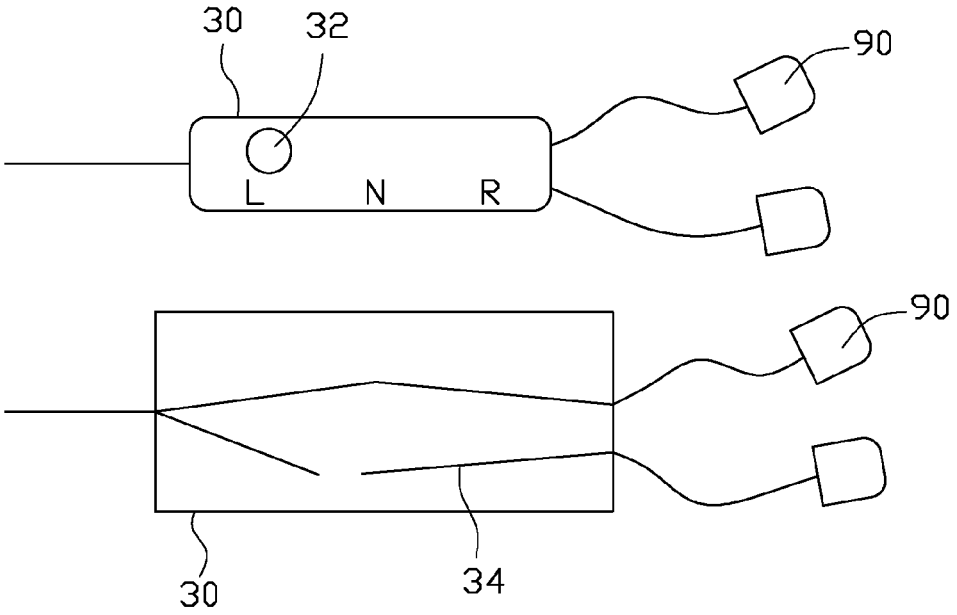
FIG. 3 is an isometric view of the second embodiment of the manual controlling mode of the headphone controlling system in a second state.
Figure 4:
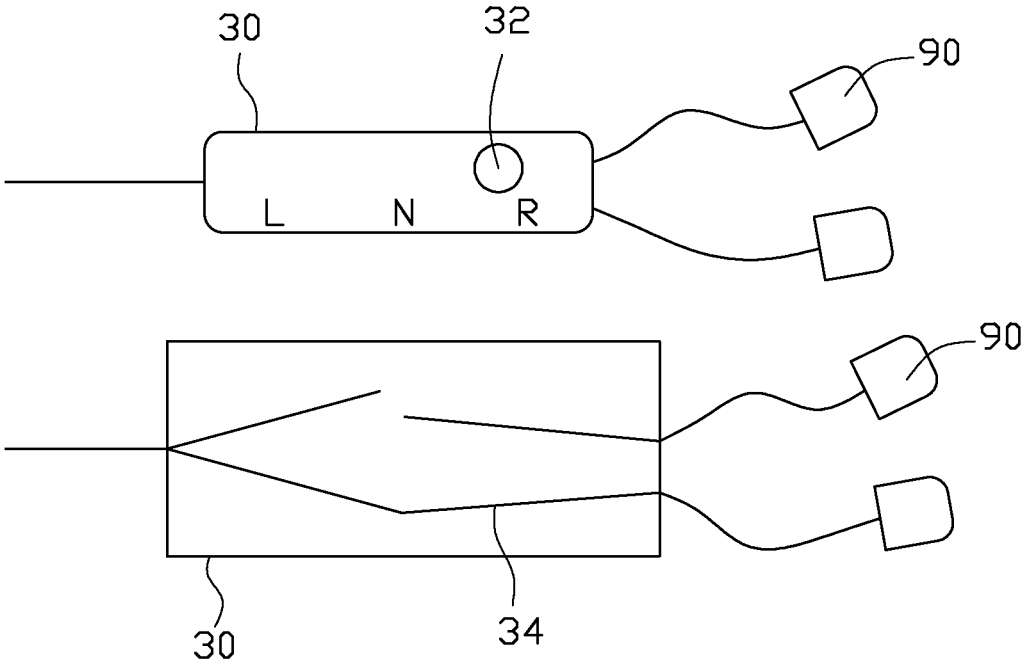
FIG. 4 is an isometric view of the second embodiment of the manual controlling mode of the headphone controlling system in a third state.

FIGS. 2, 3 and 4 illustrate that in the second embodiment of the present disclosure, the manual controlling module 30 is a physical switch assembled on a headphone 90. The manual controlling module 30 includes a simulated switch 32 and an operating button 34. The simulated switch 32 includes two routes and the operating button 34 includes three gears, that is a normal gear (N gear), a right gear (R gear), and a left gear (L gear). When the operating button 34 is in the normal gear, the two routes of the simulated switch 32 are both closed, the headphone 90 plays audio on two channels. When the operating button 34 is in the right gear, a left route of the simulated switch 32 is opened, while a right route is closed, the headphone 90 plays audio on the right channel and stops playing on the left channel. When the operating button 34 is in the left gear, a right route of the simulated switch 32 is opened, while a left route is closed, the headphone 90 plays audio on the left channel and stops playing on the right channel.

The headphone controlling system 100 can switch the playing mode of the headphone according to the location of the portable electronic device 1. When the positioning module 60 locates the portable electronic device 1 in the marked heavy traffic on the map, the headphone controlling system 100 switches the headphone to the single channel mode, thus user can keep enjoying the audio on one channel and pay more attention to the surrounding environment. Therefore, the headphone controlling system 100 is convenient to be used and has an increased safety factor for users.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. A headphone controlling system used in a portable electronic device to control playing modes of a headphone connected to the portable electronic device, the playing modes of the headphone comprising a two channel playing mode and a single channel playing mode, the headphone controlling system comprising:

a processor;

a storage module coupled to the processor and configured for storing map data, street traffic data, and automatic control information;

a manual controlling module coupled to the processor and configured to manually switch the playing mode;

a positioning module coupled to the processor and configured to determine a location of the portable electronic device corresponding to the map data and the street traffic data; and a switching module coupled to the processor and configured for switching the playing mode of the headphone;

wherein when it is determined that the location of the portable electronic device is on a heavy traffic street in the map according to the location corresponding to the map data and the street traffic data, the positioning module transmits the automatic control information in the storage module to the processor to generate and transmit a control signal according to the automatic control information to the switching module, thereby automatically switching the playing mode from the two channel playing mode to the single channel playing mode.

2. The headphone controlling system as claimed in claim 1, further comprising a selecting module selecting a manual controlling mode or an automatic controlling mode to switch the playing mode of the headphone.

3. The headphone controlling system as claimed in claim 2, wherein when the selecting module selects the manual controlling mode, the manual controlling module inputs manual control information and transmits to the processor, the processor generates and transmits the control signal to the switching module, the switching module switches the playing mode of the headphone accordingly.

4. The headphone controlling system as claimed in claim 3, wherein when the selecting module selects the automatic controlling mode, the positioning module locates the portable electronic device from ordinary unmarked street on the map to the marked heavy traffic on the map, and then the positioning module captures and transmits the automatic control information to the processor, the processor generates and transmits the control signal to the switching module, the switching module switches the playing mode of the headphone accordingly.

5. The headphone controlling system as claimed in claim 4, further comprising a setting module, wherein the setting module is configured for setting the map data, the street traffic data, and automatic control information in the storage module.

6. The headphone controlling system as claimed in claim 5, further comprising an audio outputting module, wherein the audio outputting module is configured for outputting audio after audio processed by the switching module.

7. The headphone controlling system as claimed in claim 6, wherein the storage module further stores automatic restoring control information, when the positioning module locates the portable electronic device out of the marked heavy traffic on the map, the positioning module transmits the automatic restoring control information in the storage module to the processor to restore the playing mode of the headphone.

8. The headphone controlling system as claimed in claim 1, wherein the manual controlling module is a user interface, the manual control information is inputted by users via the user interface.

9. The headphone controlling system as claimed in claim 1, wherein the manual controlling module comprises a simulated switch and an operating button, the simulated switch includes two routes and the operating button includes three gears, which is a normal gear, a right gear, and a left gear, when the operating button is in the normal gear, the two routes of the simulated switch are both closed, thus to control the headphone playing audio on both two channels; when the operating button is in the right gear, a left route of the simulated switch is opened, while a right route is closed, thus to control the headphone playing audio on the right channel; when the operating button is in the left gear, a right route of the simulated switch is opened, while a left route is closed, thus to control the headphone playing audio on the left channel.

10. The headphone controlling system as claimed in claim 1, wherein the positioning module comprises a Global Positioning System function and operates cooperatively with the map data and the street traffic data in the storage module.

11. A portable electronic device comprising a headphone and a headphone controlling system, the headphone controlling system configured to control playing modes of a headphone, the playing modes of the headphone comprising a two channel playing mode and a single channel playing mode, the headphone controlling system comprising:

a processor;

a storage module coupled to the processor and configured for storing map data, street traffic data, and automatic control information;

a manual controlling module coupled to the processor and configured to manually switch the playing mode;

a positioning module coupled to the processor and configured to determine a location of the portable electronic device corresponding to the map data and the street traffic data; and a switching module coupled to the processor and configured for switching the playing mode of the headphone;

wherein when it is determined that the location of the portable electronic device is on a heavy traffic street in the map according to the location corresponding to the map data and the street traffic data, the positioning module transmits the automatic control information in the storage module to the processor to generate and transmit a control signal according to the automatic control information to the switching module, thereby automatically switching the playing mode from the two channel playing mode to the single channel playing mode.

12. The portable electronic device as claimed in claim 11, further comprising a selecting module selecting a manual controlling mode or an automatic controlling mode to switch the playing mode of the headphone.

13. The portable electronic device as claimed in claim 12, wherein when the selecting module selects the manual controlling mode, the manual controlling module inputs manual control information and transmits to the processor, the processor generates and transmits the control signal to the switching module, the switching module switches the playing mode of the headphone accordingly.

14. The portable electronic device as claimed in claim 13, wherein when the selecting module selects the automatic controlling mode, the positioning module locates the portable electronic device in the marked heavy traffic on the map, and then the positioning module captures and transmits the automatic control information to the processor, the processor generates and transmits the control signal to the switching module, the switching module switches the playing mode of the headphone accordingly.

15. The portable electronic device as claimed in claim 14, further comprising a setting module, wherein the setting module is configured for setting the map data, the street traffic data, and automatic control information in the storage module.

16. The portable electronic device as claimed in claim 15, further comprising an audio outputting module, wherein the audio outputting module is configured for outputting audio after audio processed by the switching module.

17. The portable electronic device as claimed in claim 16, wherein the storage module further stores automatic restoring control information, when the positioning module locates the portable electronic device out of the marked heavy traffic on the map, the positioning module transmits the automatic restoring control information in the storage module to the processor to restore the playing mode of the headphone.

18. The portable electronic device as claimed in claim 11, wherein the manual controlling module is a user interface, the manual control information is inputted by user via the users interface.

19. The portable electronic device as claimed in claim 11, wherein the manual controlling module comprises a simulated switch and an operating button, the simulated switch includes two routes and the operating button includes three gears, which is a Normal gear, a right gear, and a left gear, when the operating button is in the normal gear, the two routes of the simulated switch are both closed, thus to control the headphone playing audio on both two channels; when the operating button is in the right gear, a left route of the simulated switch is opened, while a right route is closed, thus to control the headphone playing audio on the right channel; when the operating button is in the left gear, a right route of the simulated switch is opened, while a left route is closed, thus to control the headphone playing audio on the left channel.

20. The portable electronic device as claimed in claim 11, wherein the positioning module comprises a Global Positioning System function and operates cooperatively with the map data and the street traffic data in the storage module.

* * * * *